US006654586B2

(12) United States Patent
Lyon et al.

(10) Patent No.: US 6,654,586 B2
(45) Date of Patent: Nov. 25, 2003

(54) AUTOMATIC RESTACKING TRAY SIDE GUIDE REPOSITIONING SYSTEM PROVIDING SHEET STACKING SCATTER REDUCTION

(75) Inventors: Donald J. Lyon, Macedon, NY (US); Jacob Eyngorn, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/103,596

(22) Filed: Mar. 20, 2002

(65) Prior Publication Data

US 2003/0180078 A1 Sep. 25, 2003

(51) Int. Cl.[7] ..... G03G 15/00

(52) U.S. Cl. ..... 399/367; 399/369

(58) Field of Search ..... 399/361, 365, 399/367, 368, 369, 370, 371, 377; 271/3.01, 3.02

(56) References Cited

U.S. PATENT DOCUMENTS

| | | | | |
|---|---|---|---|---|
| 5,946,527 A | | 8/1999 | Salgado et al. | 399/82 |
| 6,304,742 B1 | * | 10/2001 | Nunes et al. | 399/361 |
| 6,401,606 B1 | | 6/2002 | Sato | 101/118 |

FOREIGN PATENT DOCUMENTS

| | | |
|---|---|---|
| EP | 0987606 | 3/2000 |

* cited by examiner

*Primary Examiner*—Hoan Tran

(57) ABSTRACT

In a document feeder with a superposed sheet input tray and sheet output stacking tray for feeding and then restacking print media paper sheets of variable dimensions, the lateral setting (repositioning) of the at least one variable position side guide of the input tray to the sides of the input sheets automatically correspondingly resets the corresponding side guide of the underlying output stacking tray, to reduce sheet scattering in the sheet stacking, especially skewed sheets. This may be accomplished by a simple direct mechanical integration of these respective side guides into a single repositionable component with upper and lower extending sheet edge guide portions.

8 Claims, 5 Drawing Sheets

AUTOMATIC RESTACKING TRAY SIDE GUIDE REPOSITIONING SYSTEM PROVIDING SHEET STACKING SCATTER REDUCTION

Disclosed herein is a simple and low cost system for automatically resetting one or both side guides of a sheet stacking tray in coordination and correspondence with the positioning of the side guide(s) of a sheet input tray (of a document handler input tray or a print media sheet input tray) to accommodate changes in the sizes of the sheets being fed and stacked, and to reduce output stack sheet scattering, especially skewed sheets stacking.

In the specific disclosed embodiment, the lateral setting (repositioning) of the (existing) variable position side guide in the input tray of a document handler (DH) to the side(s) of a stack of input sheets automatically correspondingly resets a side guide of an underlying (or overlying) output stacking tray, to reduce output stack sheet scattering (skewed stacking). In this embodiment, this is accomplished by a simple direct mechanical integration of these respective side guides of the respective trays or bins. Any increase in UMC is very small in the disclosed embodiment, since no additional sensors, motors, or solenoids are required.

By way of background, heretofore, normally a sheet output stacking tray does not have any variable position side guides. A key reason is that resetting such guides in an output stacking tray to a proper position that would not interfere with the stacking of larger (wider) sheets without overlapping the side guides or stubbing on them, would be too likely to be overlooked when an operator changes the size of the input sheets. It would require the operator to remember an extra, non-intuitive operation.

In the embodiment herein, there is shown an method and apparatus for controlling and reducing lateral sheet scatter in the output stack for various paper sizes by paper guide(s) which move together with, and may be directly mechanically attached to, the feeder/input paper guide(s). Adjustment of the input tray side guides automatically results in a corresponding adjustment of the output tray guides positioning. This disclosed system is suitable for various document handlers for document imaging systems and/or printers or multifunction machines, especially where a sheet input and output tray are in close proximity and/or superposed. It may be used with either separate or integral input and output trays.

One example of a prior art document handler with an input tray with adjustable side guides, of the type in which the two side guides are linked by a rack and pinion mechanism to move toward or away from each other by the same amount, to provide centered sheet feeding, is shown in Xerox Corp. U.S. Pat. No. 5,946,527. Two of its figures are provided herein, labeled "Prior Art."

The present system can provide improved sheet stacking at lower speeds as well as higher speeds. By way of further background, as sheet feeding and stacking is desired at higher rates of speed, for example, to provide the feeding and scanning of original documents at rates of 120 documents per minute, or the like, the difficulty in neatly restacking the sheets is greatly increased. This is due to various effects, increasing with the velocity and sequential rate of the sheets being ejected into the output tray. For example, normal size sheets being outputted at an exemplary 120 documents per minute sequential rate may have a velocity of about 5.4 cm/sec. This may even cause what is called "airplaning," especially of sheets with curled lead edges. Sheets being ejected to stack tend to "float," due to air trapped under a sheet. The ejected sheet tends to drop onto the top of the underlying sheets of the output stack relatively slowly due to the relatively small force provided by gravity, especially for lighter weight sheets, as compared to the resistance of the air under the sheet. A high stacking rate provides very little inter-document time for the sheet to settle neatly before the next sheet enters the output tray, and the incoming sheet may slide laterally relative to the preceding sheet, or even impact it. Also, heavier sheets have higher kinetic energy. Thus, without additional physical stacking assistance, sheets being stacked in an output tray at a high rate of speed tend to form an unacceptably scattered stack, especially if not lateral confined during their settling. The term "scattered" herein includes, but is not limited to, sheets being unacceptably skewed relative to one another and/or being unacceptably laterally displaced from one another, as compared to being neatly superposed.

As noted, manually operator adjusted output stacking side guides and end guides can reduce such sheet scattering, but this has a significant disadvantage in the prior art. Namely, every time the lateral size of the sheets being fed in from the input tray changes, the operator must remember to also reset the side guides of the output tray to the same sheet dimension, or risk sheet jams or other problems. Hence, as in the above-cited and other such patents, often no repositionable side guides at all are provided in the output stacking tray. Or, electromechanical lateral side edge and or end of stack tampers are provided, at additional cost and complexity.

In this particular patent they word "imaging system" is being used broadly to encompass various conventional or other image reading or image printing systems. For example, image reading systems include conventional CCD array imaging bars, such as used in various commercially available document scanners, digital copiers, facsimile machines, or multifunction devices. However, in this application the term "imaging system" is being more broadly used to also encompass various image printing systems, such as the print heads of inkjet printers, xerographic printers, or other conventional image printing systems. Since these, and various sheet feeders, are all well known per se, they need not be described herein. This term "imaging system" is being more broadly used herein because the present system is suitable for either the feeding, image capturing, and restacking of original documents; or the feeding, printing and stacking of blank sheets. In both cases, the same type of sheets may need to be handled. That is, both may involve feeding of varying dimensions of paper or plastic print media sheets into an apparatus and their stacking in a sheet stacking output tray. In both cases, sheet scatter problems can be encountered if the sheets are not properly laterally confined during restacking after ejection into an output stacking tray.

In the disclosed embodiment, the above and other problems are overcome by vertical side guides in the output tray, at least one of which automatically moves in coordination with the setting of the input tray document stack side guide(s). One or both input tray side guides may be conventionally set by the operator by moving them against the sides of a stack of input documents. In the disclosed system this also automatically resets output tray side guides surfaces to a corresponding position in which the inputted sheets will neatly output stack in the output tray between output tray side guides which are automatically set to that same lateral sheet dimension, thereby reducing the opportunity for those outputted sheets to settle randomly.

As shown and described in the disclosed embodiment, the side-guides of the output tray can even desirably be a simple integral extension or part of the input tray side guides, at little additional cost, without requiring any motors or sensors, and without requiring any operator resetting of these output tray side guides.

As disclosed herein, the vertical side guides of the input tray may be connected to one another through a conventional rack-and-pinion system, as illustrated in prior document handler patents, such the above-cited Xerox Corp. U.S. Pat. No. 5,946,527 (or others) and its corresponding FIGS. 3 and 4 here labeled "Prior Art." Thus, operator resetting of the sheet-retaining space between the two side guides of the input tray can be accomplished by operator movement of one of them. While fully compatible therewith, the present system is not limited thereto, especially since this is a "center registered" system, whereas other systems are "side registered."

Although in the disclosed embodiment a "center registered" system is provided, in which two side guides of the input tray can move towards or away from each other (i.e., both side guides can move), that this is not required. There are alternative systems which can also be provided with the disclosed system, and are intended to be covered by the claims, in which one side guide is a fixed side wall and only the opposite side guide is moveable, to provide an "edge registered" system instead of a "center registered" system.

It will also be noted that the disclosed lower or output tray side stacking guides may, as shown, be positioned downstream or upstream of the upper or input tray side stacking guides by the disclosed system to provide additional design flexibility and a more preferred position of the side guides for both. This is also a matter of design choice.

A specific feature of the specific embodiment(s) disclosed herein is to provide a print media sheet handling and imaging system with a sheet input tray, a sheet feeder, and a sheet stacking output tray, wherein said print media sheets of varying lateral dimensions may be sequentially fed from said sheet input tray by said sheet feeder to said imaging system and then ejected into said sheet stacking output tray for stacking superposed therein, wherein said sheet input tray has at least one laterally repositionable sheet side guide which is repositionable to said varying lateral dimensions of said print media sheets which are being fed from said sheet input tray by said sheet feeder to said imaging system; and wherein said sheet stacking output tray has at least one laterally repositionable sheet side guide repositionable to said varying lateral dimensions of said print media sheets which are being fed from said sheet input tray by said sheet feeder to said imaging system; and wherein said at least one laterally repositionable sheet side guide of said sheet stacking output tray is automatically laterally repositioned by said lateral repositioning of said sheet side guide in said sheet input tray into a position providing sheet stacking scatter reduction of said print media sheets of varying lateral dimensions being ejected into said sheet stacking output tray for stacking superposed therein.

Further specific features disclosed in the embodiment(s) herein, individually or in combination, include those wherein said at least one laterally repositionable sheet side guide of said sheet stacking output tray is mechanically connected to move with said at least one laterally repositionable sheet side guide of said sheet input tray, and/or said at least one laterally repositionable sheet side guide of said sheet stacking output tray is an integral extension of said at least one laterally repositionable sheet side guide of said sheet input tray, and/or wherein said sheet feeder is feeding said print media sheets at a rate of approximately 120 sheets per minute or faster, and/or wherein said print media sheets are image bearing sheets and said imaging system is digitally scanning said image bearing sheets, and/or wherein said print media sheets are being printed by said imaging system, and/or wherein said sheet input tray and said sheet stacking output tray are superposed and said at least one laterally repositionable sheet side guide of said output tray is a downward extension of said at least one laterally repositionable sheet side guide of said sheet input tray, and/or wherein said at least one laterally repositionable sheet side guide of said output tray and said at least one laterally repositionable sheet side guide of said sheet input tray are both horizontally and vertically offset relative to one another.

As to specific components of the subject system, or alternatives therefor, it will be appreciated that, as is normally the case, some such components are known per se in other apparatus or applications, which may be additionally or alternatively used herein, including those from art cited herein. For example, it will be appreciated by engineers and others that many of the particular components illustrated or suggested herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the one example below, and the claims. Thus, the present invention will be better understood from this description of these specific embodiment(s), including the drawing figures (which are approximately to scale) wherein:

Figure 4:
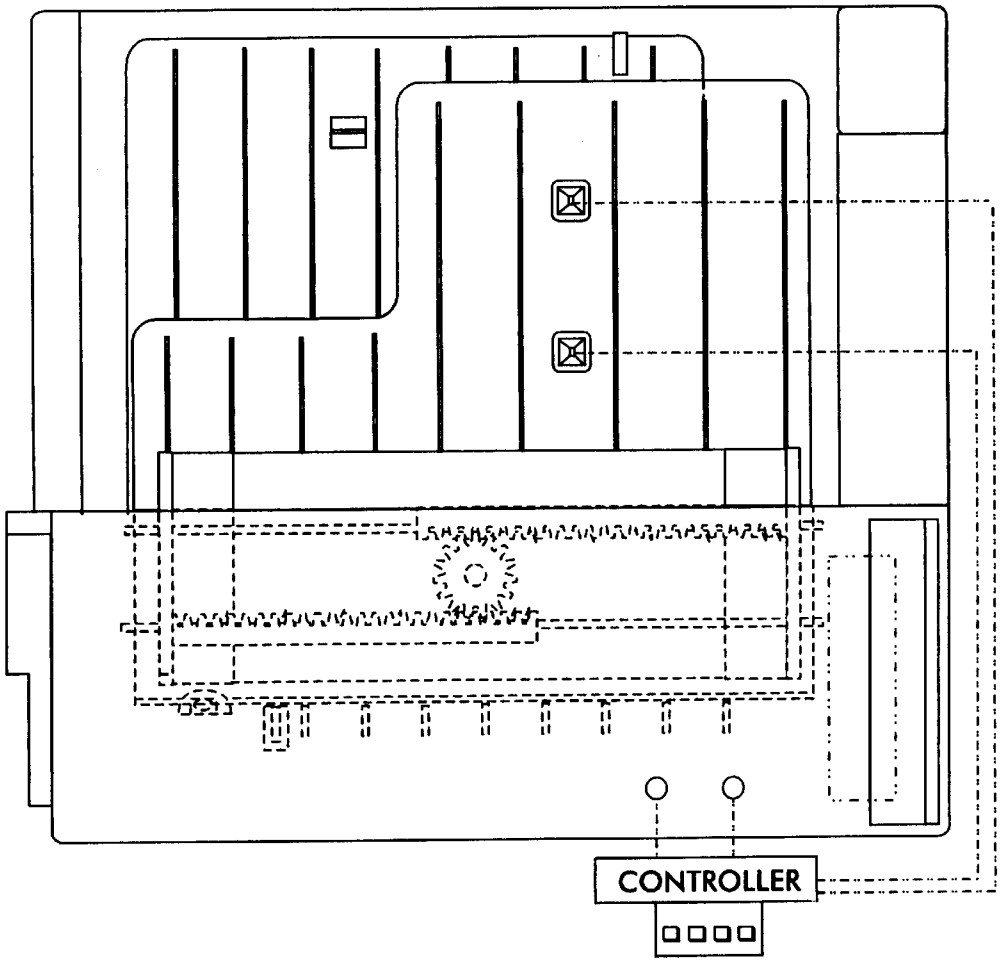
FIG. 4 PRIOR ART
Figure 5:
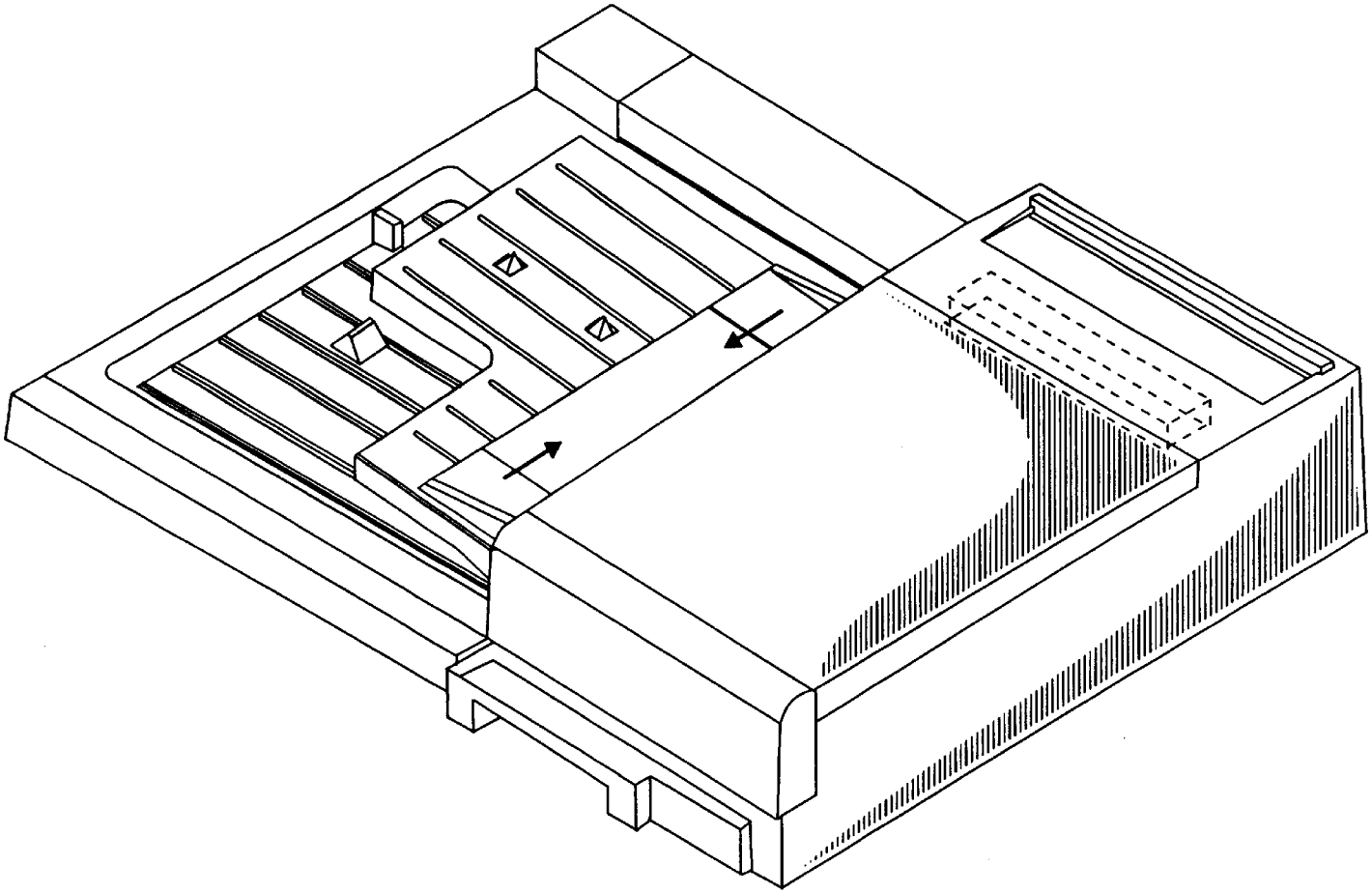
FIG. 5 PRIOR ART

FIG. 4, labeled "prior art," is one of the above-described figures from the above-cited document handler patent, in a top view; and FIG. 5, also labeled "prior art," is another, perspective, figure copied from the above-cited document handler patent.

Figure 1:
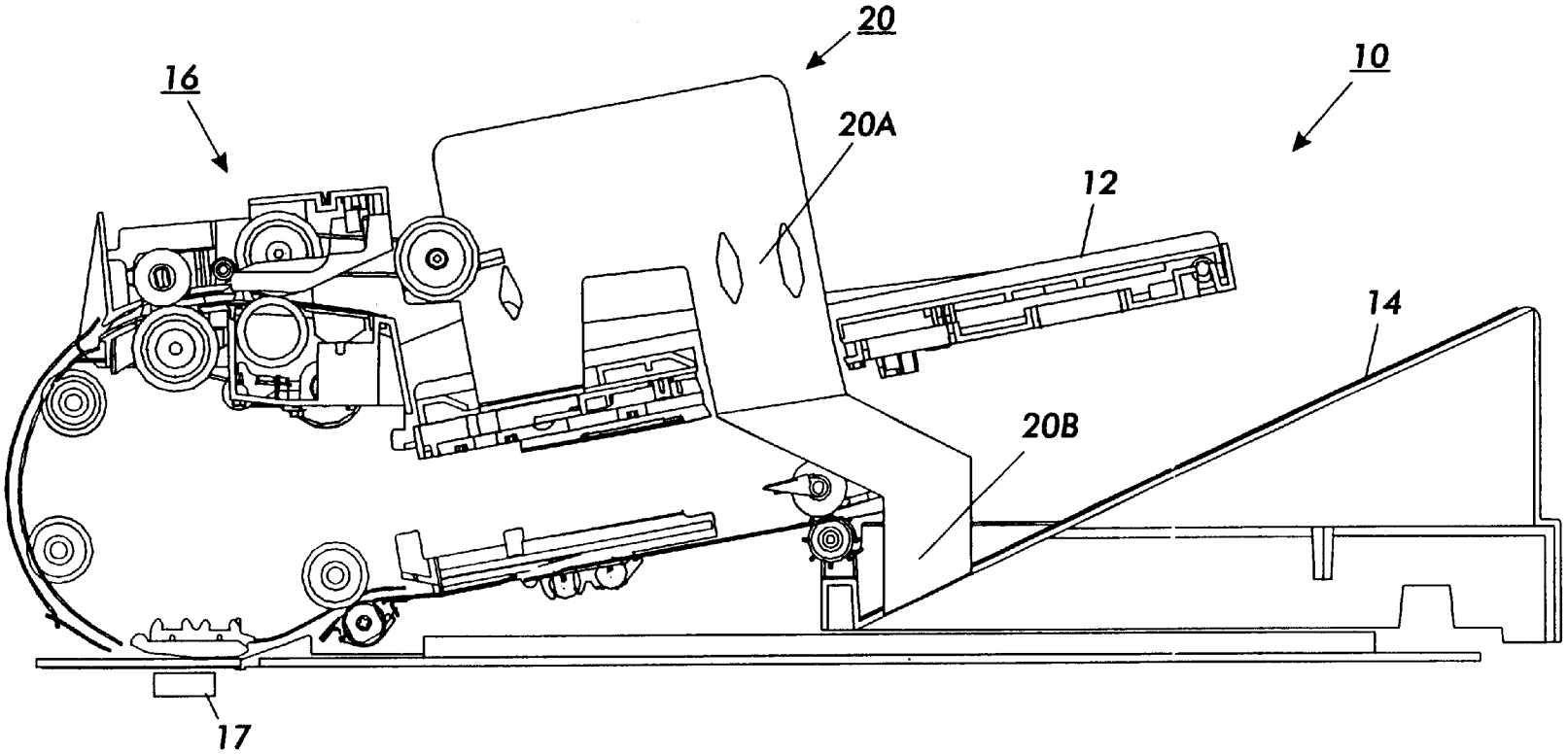
FIG. 1 is a frontal view, partially broken away to illustrate one side of the exemplary integrated sheet side guides system for the input and output trays illustrated as part of an exemplary document handling system.
Figure 2:
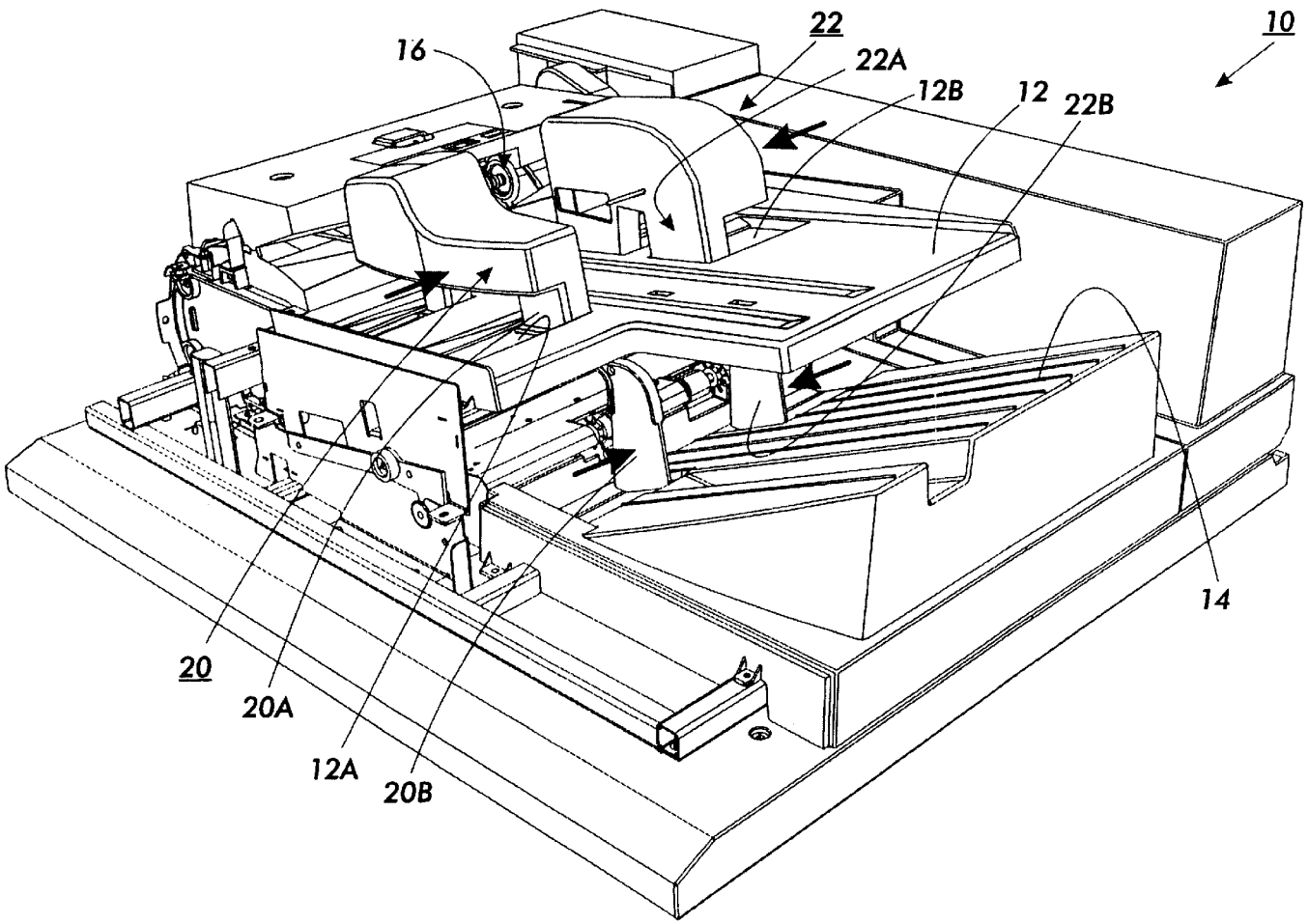
FIG. 2 is a perspective view of the system of FIG. 1.

Describing now in further detail the exemplary embodiment with reference to the Figures, there is shown in FIGS. 1 and 2 a document handler (DH) 10, by way of one example of the application of one example of the subject integrated sheet side guides system. It will be appreciated that numerous other variations are possible, as illustrated by the above-cited and other patents.

In this exemplary DH 10, a document input tray 12 is superimposed over a document output sheet stacking tray 14. Sheets are sequentially fed from the document input tray 12 by and through a sheet feeding system 16, which feeds the sheets past a document imaging system 17, as described above. Then the documents may be ejected (or inverted and then ejected) into the output tray 14. Moveable side guides 20 and 22 are provided for setting to the size of the documents being fed in the document input tray 12. Specifically, upper portions 20A and 22A of these side guides 20, 22 are positioned to engage the sides of the stack of sheets in the input tray 12. However, here these movable side guides 20, 22 have lower extensions 20B and 22B (the lower extension 20B is illustrated in FIG. 1), which extend down through input tray 12 apertures 12A, 12B into the output tray 14. In the output tray 14, these lower extensions 20B and 22B of side guides 20 and 22 provides vertical side guides for the sheets being output stacked in the output tray 14.

It may be seen that whenever the upper portions 20A, 22A of the side guides 20, 22 are manually reset by the operator, this moves by the same distance and position the lower extensions 20B and 22B thereof to automatically reset those side guides for the output stacking tray 14 to the same dimension of sheets as are being inputted from the input tray 12. This automatically provides effective control over sheet scattering in the output tray 14, yet avoids the addition of another operator adjustment which may easily be forgotten by an operator. Yet these automatic features can be provided at very little incremental cost.

Figure 3:
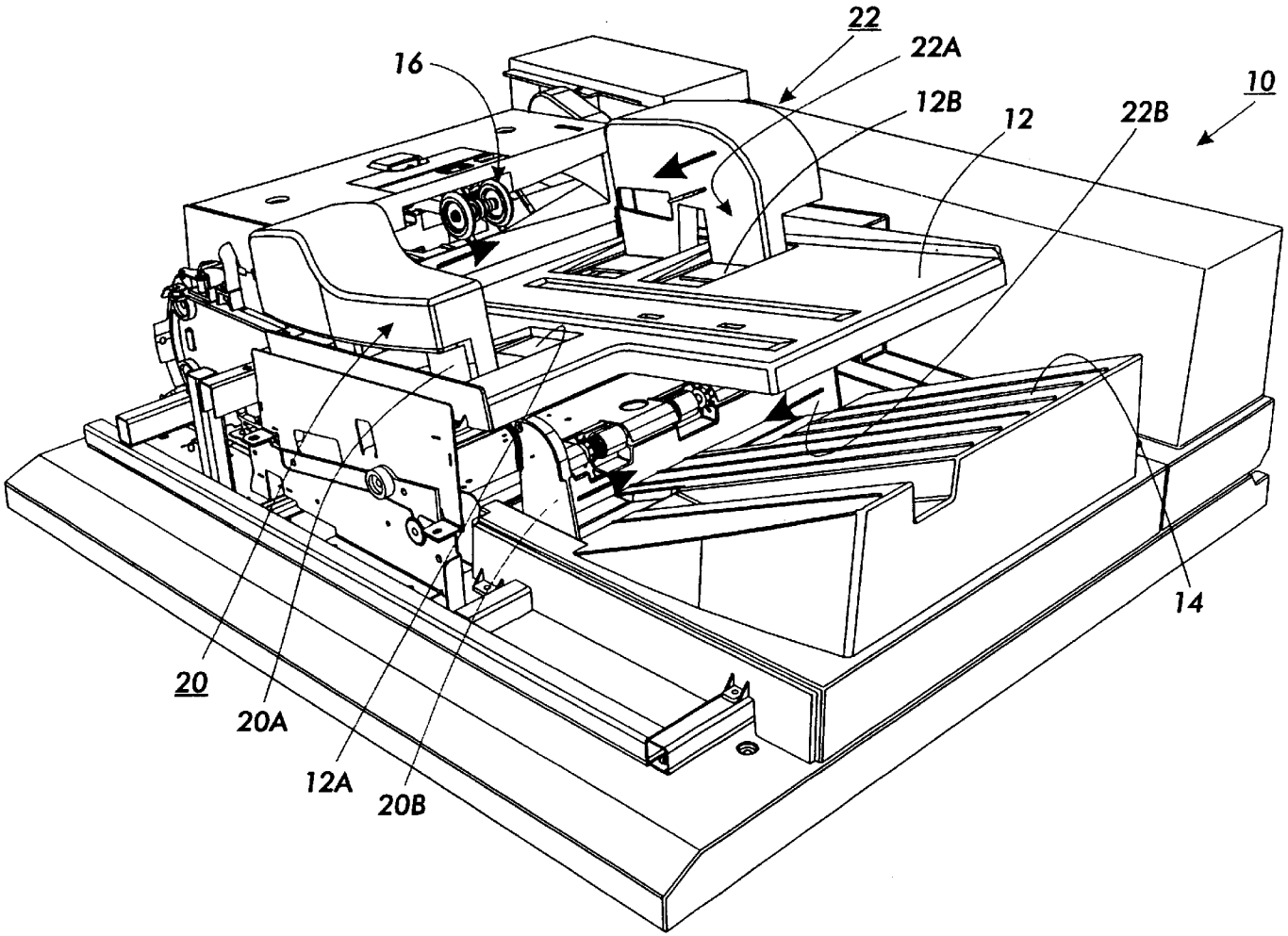
FIG. 3 is the same view as FIG. 2, showing different spacing of the side guides for different size sheets.

An operator will almost always have to open the input tray side or edge guides 20A, 22A wide enough to accommodate loading wider sheets in the input tray 12. That will automatically here also widen the lower or output tray 14 side guides by the same amount to allow proper stacking in between them. See the difference between FIGS. 2 and 3. Even if an operator fails to properly re-adjust the input tray guides 20A, 22A more closely together against the sides of a narrower stack of input sheet, so that those upper side guides 20A, 22A are too far apart, this will only allow a correspondingly extra opening between the output tray side guides, so they would not actually interfere with stacking.

As also shown in this embodiment, the output stacking tray may have a substantial enough inclined angle from the horizontal, e.g. 25° or more, so as to allow the documents being outputted into the output tray to slide back down toward the front vertical wall of the output tray and stack properly in the feeding or process direction. Again, while not required, this provides further cooperation with the subject automatically re-adjustable side guides for improved uniformity of output stacking of the ejected sheets.

While the embodiment disclosed herein is preferred, it will be appreciated from this teaching that various alternatives, modifications, variations or improvements therein may be made by those skilled in the art, which are intended to be encompassed by the following claims.

What is claimed is:

1. A print media sheet handling and imaging system with a sheet input tray, a sheet feeder, and a sheet stacking output tray, wherein said print media sheets of varying lateral dimensions may be sequentially fed from said sheet input tray by said sheet feeder to said imaging system and then ejected into said sheet stacking output tray for stacking superposed therein, wherein said sheet input tray has at least one laterally repositionable sheet side guide which is repositionable to said varying lateral dimensions of said print media sheets which are being fed from said sheet input tray by said sheet feeder to said imaging system; and wherein said sheet stacking output tray has at least one laterally repositionable sheet side guide repositionable to said varying lateral dimensions of said print media sheets which are being fed from said sheet input tray by said sheet feeder to said imaging system; and wherein said at least one laterally repositionable sheet side guide of said sheet stacking out put tray is automatically laterally repositioned by said lateral repositioning of said sheet side guide in said sheet input tray into a position providing sheet stacking scatter reduction of said print media sheets of varying lateral dimensions being ejected into said sheet stacking output tray for stacking superposed therein.

2. The print media sheet handling and imaging system of claim 1, wherein said at least one laterally repositionable sheet side guide of said sheet stacking output tray is mechanically connected to move with said at least one laterally repositionable sheet side guide of said sheet input tray.

3. The print media sheet handling and imaging system of claim 1, wherein said at least one laterally repositionable sheet side guide of said sheet stacking output tray is an integral extension of said at least one laterally repositionable sheet side guide of said sheet input tray.

4. The print media sheet handling and imaging system of claim 1, wherein said sheet feeder is feeding said print media-sheets at a rate of approximately 120 sheets per minute or faster.

5. The print media sheet handling and imaging system of claim 1, wherein said print media sheets are image bearing sheets and said imaging system is digitally scanning said image bearing sheets.

6. The print media sheet handling and imaging system of claim 1, wherein said print media sheets are being printed by said imaging system.

7. The print media sheet handling and imaging system of claim 1, wherein said sheet input tray and said sheet stacking output tray are superposed and said least one laterally repositionable sheet side guide of said output tray is a downward extension of said at least one laterally repositionable sheet side guide of said sheet input tray.

8. The print media sheet handling and imaging system of claim 1, wherein said at least one laterally repositionable sheet side guide of said output tray and said at least one laterally repositionable sheet side guide of said sheet input tray are both horizontally and vertically offset relative to one another.

* * * * *